US007104337B2

(12) United States Patent
Jones

(10) Patent No.: US 7,104,337 B2
(45) Date of Patent: Sep. 12, 2006

(54) ELECTROSTATIC FIRE CONTROL AND EXTINGUISHING DEVICE

(76) Inventor: David Everett Jones, 2488 Coronet Ct., Spring Hill, FL (US) 34609

( * ) Notice: Subject to any disclaimer, the term of this patent is extended or adjusted under 35 U.S.C. 154(b) by 90 days.

(21) Appl. No.: 10/403,274

(22) Filed: Apr. 1, 2003

(65) Prior Publication Data

US 2004/0216898 A1 Nov. 4, 2004

(51) Int. Cl.
*A62C 2/00* (2006.01)
*A62C 3/00* (2006.01)

(52) U.S. Cl. ..... 169/46; 169/46; 169/48; 169/DIG. 3; 169/43

(58) Field of Classification Search ..... 169/46
See application file for complete search history.

(56) References Cited

U.S. PATENT DOCUMENTS 3,740,570 A 6/1973 Kaelin et al.
3,765,842 A 10/1973 Purt
4,168,903 A * 9/1979 Tolmie ..... 399/91
4,688,644 A 8/1987 Hemming
5,090,482 A * 2/1992 Baron et al. ..... 169/46
5,752,381 A * 5/1998 Speller ..... 60/228
5,794,704 A * 8/1998 Brennecke et al. ..... 169/54
2003/0178568 A1* 9/2003 Parham et al. ..... 250/338.1

* cited by examiner

*Primary Examiner*—David A. Scherbel
*Assistant Examiner*—James S. Hogan
(74) *Attorney, Agent, or Firm*—Siemens Patent Services

(57) ABSTRACT

A fire's electrostatic field is used to directly control and extinguish a fire. A flame is, in and of itself, a virtual electrode. The inventive electro-static fire control and extinguishing device uses at least one common electrode and allows the fire's own electrostatic field to act as the other virtual electrode to repel the fire's flame, controlling the spread of the fire or to control its direction or to totally extinguish it. The electro-static fire control and extinguishing device exploits the electrostatic properties of the fire's flame, directly using at least one electrode set at the appropriate electrostatic charge to create the desired fire control while the fire acts as the second source of the electrostatic field in which the electrostatic attraction/repulsion interaction takes place. A high voltage electrostatic field is produced by a high voltage static generator and the desired charge level is delivered to the flame via a conductive grid.

10 Claims, 3 Drawing Sheets

ELECTROSTATIC FIRE CONTROL AND EXTINGUISHING DEVICE

BACKGROUND OF THE INVENTION

1. Field of the Invention

The present invention relates to fire control and extinguishing apparatus and, more particularly, to a device employing electrostatic charges to extinguish flames.

2. Discussion of the Prior Art

In most cases, fires are controlled and extinguished using water and/or chemicals. However, the prior art teaches of using electrostatic energy to detect and extinguish fires.

The U.S. Patent to Hemming issued on Aug. 25, 1987, as U.S. Pat. No. 4,688,644, discloses an ignition and fire suppressing system for an electrostatic sprayer. The system uses a pressurized, non-ignitable fire suppressing gas source that makes use of electrical properties of flame gases to create a non-ignitable atmosphere.

The U.S. Patent to Tolmie issue Sep. 25, 1979, as U.S. Pat. No. 4,168,903, discloses a fire detecting and extinguishing system for use within a copying machine. Herein, means are provided for detecting the ionization causing a substantial increase in the conduction of energy between a pair of flame detecting electrodes. The increased current causes an alarm and the automatic ejection of a coolant or extinguishing chemical on the fire.

U.S. Pat. No. 3,765,842, issued to Purt on Oct. 16, 1973, teaches of a fire alarm signaling system wherein air is removed from spaces to be sensed and detected for the presence of certain characteristics of fire, e.g., the presence of carbon monoxide. The system provides and early warning fire alarm system for rapid detection by analyzing the dynamic properties that meet the criterion for fire.

Fire alarm and extinguishing systems have been proposed in the prior at in which various characteristics and phenomena incident to a fire are utilized to detect the presence of a fire and provide extinguishing means based on electrochemical properties, inherent in flames. None of these patents either teaches or suggests putting out fires by exploiting the fire's electrostatic properties present within the fire, with the aid of a high voltage generator generating a high voltage electrostatic field immediately proximate the fire.

SUMMARY OF THE INVENTION

Every fire consists of a flame which is a plume of multiple plumes of very hot gases, that produce not only high thermal radiating energies with different bands of light (depending on the material of the fire's fuel), but the fire also produces an electrostatic field. This electrostatic field produced in a fire leaves the flame with very desirable electrostatic properties which can be a very efficient method to control and extinguish the fire.

The present invention uses's the fire's own electrostatic field to directly control and extinguish the fire. Due to the electrostatic field of the flame, it is, in and of itself a virtual electrode. The present invention uses at least one common electrode and allows the fire's own electrostatic field to act as the other virtual electrode to repel the fire's flame to control the spread of the fire or to control its direction or to totally extinguish it.

The electro-static fire extinguishing device exploits the electrostatic properties of the fire's flame directly using at least one electrode set at the appropriate electrostatic charge to create the desired fire control while the fire acts as another source of the electrostatic field in which the electrostatic attraction/repulsion interaction takes place. High voltage electrostatic fields are produced by a high voltage static generator and the desired charge level is delivered to the flame via a conductive grid that may consist of different electrostatic conducting surfaces or bodies.

It is therefore an object of the invention to provide a fire control and extinguishing device that uses electrostatic principals to control flames.

It is another object of the invention to provide a device utilizing a high voltage electrostatic field to directly control and extinguish fires.

It is also an object of the invention to provide a fire control and extinguishing device using different levels of electrostatic fields for steering a high voltage electrostatic field to control or extinguish a flame.

It is also an object of the invention to provide an electrostatic energy generating device that manipulates the electrostatic energy of a flame to control and/or extinguish fires without using conventional means such as water or chemicals.

These and other objects, features and advantages will be more apparent from a study of the enclosed text and the appended drawings.

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

This disclosure of the invention is submitted in furtherance of the constitutional purposes of the U.S. Patent Laws "to promote the progress of science and useful arts" (Article 1, Section 8).

Generally speaking this invention relates to the confinement of a fire using only the power of electrostatic energy. To exist, a fire must have three things: fuel, oxygen, and heat. Additionally, a fire's electrostatic field had to exist and be intact for a fire to maintain it's existence. This electrostatic field exists in very dry and high temperatures. The flames of a fire are extremely dry and cannot continue when moisture invades it. Essentially, the moisture short circuits the circuit of the fire's static electricity needed to balance its combustion process.

This phenomenon is seen in nature on a broad scale during cold and dry climates, static electricity abounds. It is the fire's electrostatic field that keeps the microscopic gas molecules evenly and properly spaced apart, and in balance during the combustion process. Unequal spacing of the gas molecules, due to a fire's electrostatic collapse, causes the complicated burning dynamics of a fire to become in disarray, causing the flame of a fire to become in disarray, causing the flame of a fire to be extinguished.

Figure 1:
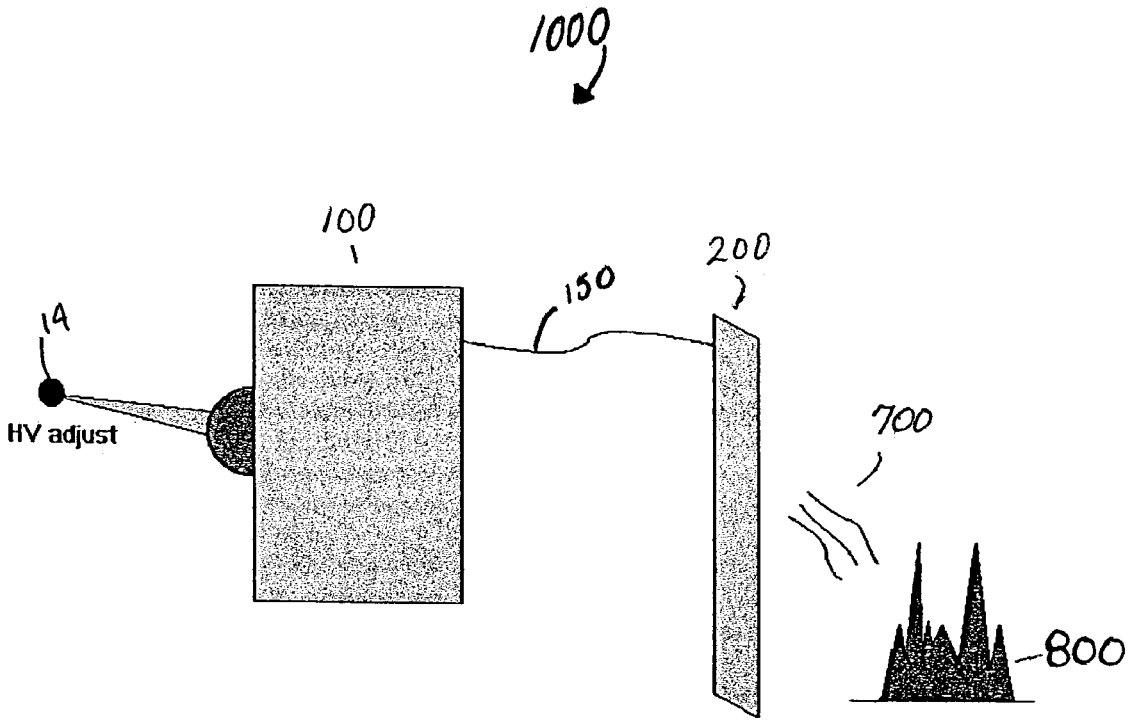
FIG. 1 is a block diagram showing the basic operation of the inventive device.

The inventive Electro-Static Fire control and extinguishing device (ESFED) 1000, as seen generally in FIG. 1, is a technology that includes the production of specialized electrostatic charges by way of a high voltage electrostatic field (HVEF) 700, established in appropriate levels with correct static field geometries. These electrostatic charges are applied to an Electrostatic Field Grid (EFG) 200 wherein the static HVEF 700 is directly delivered to a fire 800. The EFG 200 may consist of a suitable conductive material capable of carrying high voltage static electricity. The EFG 200 may also include electrostatically charged vapor streams, a mist, or charged particles. The High voltage needed is produced by an adjustable High Voltage Generator (HVG) 100.

Figure 2:
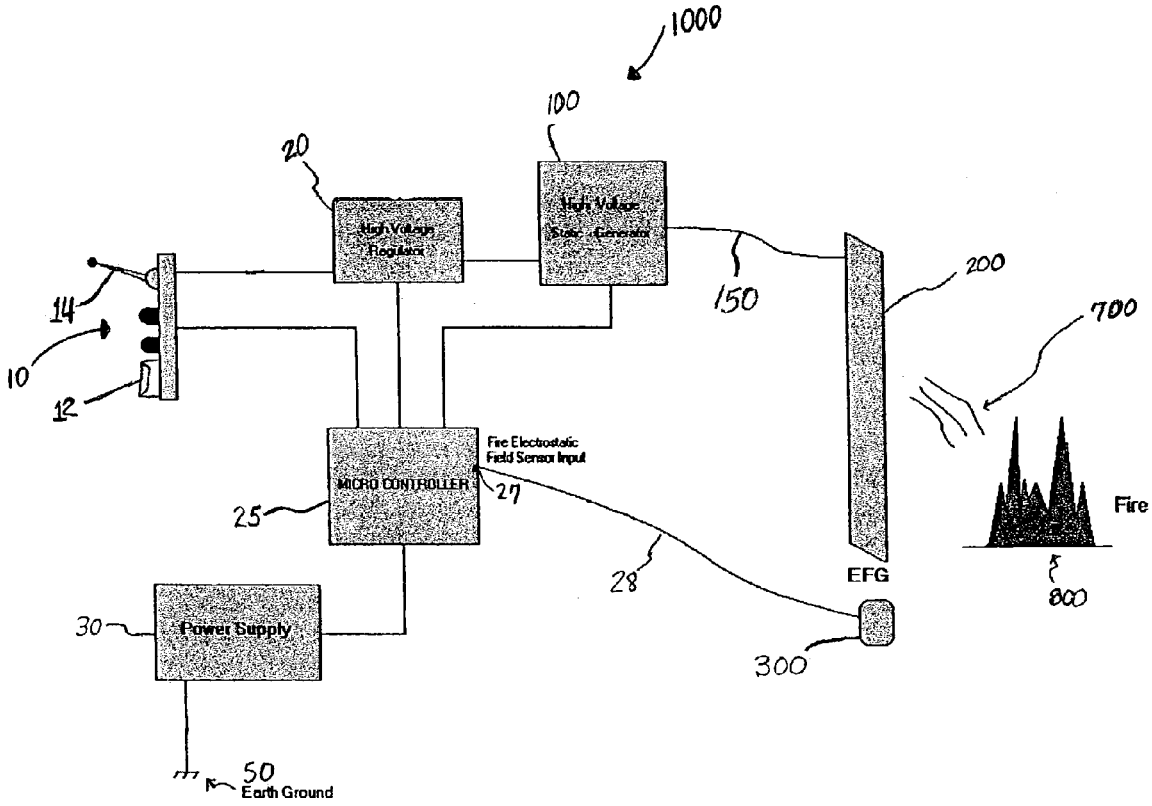
FIG. 2 is a block diagram of a first embodiment of the inventive device employing a single electrostatic field grid, in accordance with the present invention.

As illustrated in FIG. 2, the ESFED 1000 employs the use of the an EFG 200 being in the configuration of a single grid. FIG. 2 is a block diagram generally depicting a single EFG 200 embodiment delivering the HVEF 700. A control panel 10 contains user controls 14 for manually adjusting the voltage of the ESFED 1000 system. The control panel 10 may be adapted for manual control as well as for automatic control options.

The control panel 10 is configured to send commands to the microcontroller 25. The microcontroller 25 is configured to control a High Voltage Regulator (HVR) 20. The HVR 20 controls the output levels of the High Voltage Static Generator (HVSG) 100. It is the HVSG 100 that produces the electrostatic field 700. Depending on the intensity of the fire 800, the HVR 20 regulates the voltage values that the HVSG 100 will output. The HVSG 100 applies the HVEF 700 to the Electrostatic Field Grid 200 by way of a High Voltage Insulated Wire 150.

A power supply 30 provides the necessary electrical power to the ESFED 1000 system. The power supply 30 is grounded, either directly or capacitively, to the Earth Ground 50. This coupling to ground 50 guarantees efficiency of the generated electrostatic field 700. The power supply 30 can include a battery, AC household current, solar or wind power, a hand powered generator, or any combination of these, or any other suitable source of electrical power without departing from the scope of the invention. The distribution of the electrical power eminating from the power supply 30 is controlled by the microcontroller 25.

Figure 3:
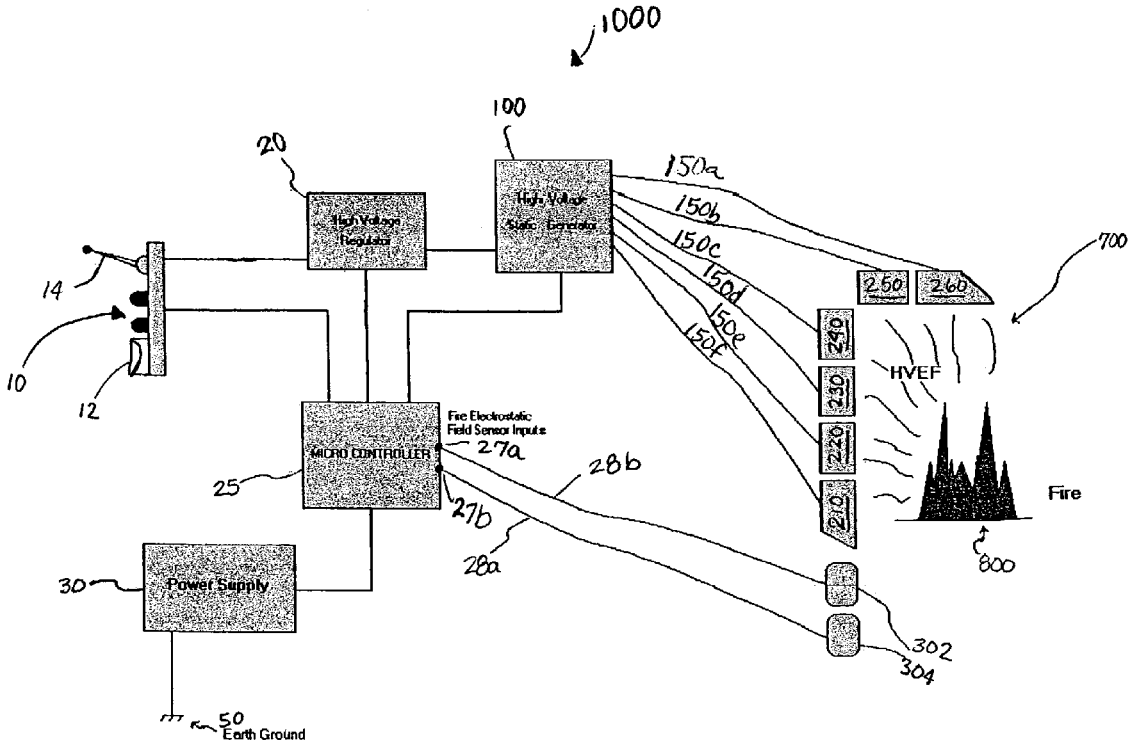
FIG. 3 is a block diagram of a second embodiment of the inventive device employing a multiple electrostatic field grid, in accordance with the present invention.

FIG. 3 illustrates the ESFED 1000 system in a second embodiment employing multiple electrostatic field grids 210–260. These Multiple Electrostatic Grid Units (MEGU) 210, 220, 230, 240, 250 and 260 provide multiple outlets of the high voltage electrostatic field 700. Each of the MEGUs (210–260) may provide different intensity levels of electrostatic field 700 via the HVSG 1000. This arrangement allows for novel electrostatic field steering which in turn gives the ESFED 1000 system more desirable control over a fire 800.

The MEGUs 210–260 may consist of different electrical conductive materials, as described above in reference to the single EFG 200, including grids made of electrical conductive materials, an electrostatically charged vapor stream, mist, charged particles or combinations thereof.

The ESFED 1000 may incorporate a feedback loop for regulating automatic operation thereof. Fire Electrostatic Sensors (FES) 300, 302 and 304 detect real-time fire characteristics being presented to the ESFED 1000. These characteristics include fire type, flame level, intensity and dimension. This is done automatically during the initial power-up or alternatively may be done by a manual re-sense command given by the operator using the control panel 10.

FIG. 2 shows a single FES 300, wherein FIG. 3 shows a multiple sensor FES 302 & 304 configuration. When the multiple sensor FES 302, 304 is used, more detailed information regarding the fire 800 is relayed. The embodiment of FIG. 2 containing multiple sensors 302, 304 may be configured to contain more complex algorithms in the microcontroller 25 and can produce a more complex and more efficient electrostatic field 700. The FES 300, 302 and 304, signal is transferred by coaxial wires 28 and 29 to the microcontroller 25 for processing to determine the best levels of HVEF 700 to use for controlling fire 800. Preprogrammed fire control and containment algorithms may be implemented within the microcontroller 25. The microcontroller 25 is adapted to provide the option of operation of a single EFG 200 in the multiple electrostatic field grid units (MEGU) 210–260 embodiment.

In both embodiments, the microcontroller 25 also transmits control signals to the control panel 10. The control panel 10 subsequently carries both the power and command signals generated by the ESFED 1000 operator back to the microcontroller 25. All ultimate power options to the HVR 20 and the HVSG 100 are established by the microcontroller 25. The microcontroller 25 is configured to contain algorithms for producing an efficient high voltage electrostatic field 700.

The resultant fire level and type indication can be viewed on a display means 12. The display means 12 may provide visual data by way of a meter or other visual indicator (not shown) adapted on the control panel 10. The display means 12 can include the following display items:

Master Power ON/OFF, Standby/Operate Mode, Manual/Automatic mode, re-sense FES, Fire Data Display Mode On/OFF, HVEF Power Level Display, Power Storage level display, Emergency Kill Over ride control, system flow chart display and single/multiple HVEF fields mode select.

The above is not an exhaustive listing as it can be appreciated by an artisan of ordinary skill in the art that other items of relevance may be displayed without departing from the scope of the invention.

In operation, during the initial power-up, the ESFED 1000 system is always defaulted into the manual mode in a standby condition until commands are issued. To prevent unauthorized use, the control panel 10 may include a security key interlock means (not shown). A manual over-ride will allow for direct user control of the levels of the HVEF 700.

When the ESFED 1000 is in operation, there is a strong force created in the interaction between the electrostatic field of the fire 800 and the EFG's 200–260. This force is quantified and used to establish the high voltage electrostatic field 700 used in the flame control. The polarity of the ESFED's 1000 grid 200 or 210–260 can be reversed to create an attraction between the EFG 200–260 and the flame 800. This action will cause the collapse of the high voltage electrostatic field 700 barrier between the fire 800 and the EFG 200–260. This change in electrostatic polarity will place the ESFED 1000 into a fire attraction mode. consequently, the EFG 200–260 will now attract the flames of the fire 800 toward it in this opposite mode transitioning. A resultant electrostatic field is produced due to the dynamic push and pull of the electromotive forces.

The electrostatic field of the fire's flame 800 and the ESFED 1000 produced high voltage electrostatic field 700 dynamically push against each other. It is because the mass of the ESFED 1000 is much more than the mass of the light gases of the fire 800 that the EFG 200–260 is able to dominate control in the dynamic reactions between the two compelling electrostatic fields. The electrostatic field's timings and pulsing of the polarities may be manipulated to enhance flame steering capabilites by the EFG 200–260.

Since other modifications and changes varied to fit particular operating requirements and environment will be apparent to those skilled in the art, the invention is not considered limited to the example chosen for purposes of disclosure, and covers all changes and modifications which do not constitute a departure from the true spirit and scope of the invention.

For example, the actual schematic representations of these two embodiments can be of various electronic design variations as represented by using different circuit design arrangements providing the same function without departing from the scope of the invention. The ESFED 1000 device, as disclosed, may also be adapted for use in different physical form variations including, but not limited to, industrial versions for warehouses, buildings, homes, outdoor fire barriers, fire proof suits, vehicles, aircraft, and/or all other items and applications in which the ESFED 1000 may be configured in future design concepts.

Having thus described the invention, what is desired to be protected by Letters Patent is presented in the subsequent appended claims.

What is claimed is:

1. An electrostatic fire control and extinguishing device for the control and extinguishing of flames, said device comprising:

a high voltage generator for generating high voltage static electricity, means for adjusting the output voltage levels of said high voltage generator, an electrostatic field grid means for conducting said static electricity, wherein:

the electrostatic field grid means is capable of forming a first electrostatic field to interact with a fire generating a fire generated electrostatic field for controlling and extinguishing flames utilizing an electrical force between the first electrostatic field acting as a first electrode and the fire generated electrostatic field acting as a virtual electrode, and p1 means for electrically coupling said high voltage generator to said electrostatic field grid means.

2. An electrostatic fire extinguishing system for the control and extinguishing of flames, said system comprising:

a) control panel means for receiving operator input, b) a high voltage static generator for producing high voltage static electricity, c) voltage regulator means for regulating the output levels of the static generator, d) controller means, said controller means:

i) controls distribution of said power supply to said voltage regulator ii) provides control signals to said high voltage static generator, and e) an electrostatic field grid means adapted for proximity placement for directly delivering a high voltage electrostatic field to a fire generating a fire generated electrostatic field for control and extinguishing of flames through an interaction utilizing an electrical force between the high voltage electrostatic field and the fire generated electrostatic field.

3. The electrostatic fire extinguishing system of claim 2 wherein, said control panel means further comprises display means for displaying at least operation modes, command options, and power distribution levels.

4. The electrostatic fire extinguishing system of claim 3, further comprising at least one electrostatic fire sensing means for obtaining real-time electrostatic data about an ensuing flame, said sensing means adapted and configured to sense fire type, fire level, fire intensity and fire dimensions, and said fire sensing means electrically coupled to said controller means via a coaxial wire.

5. The electrostatic fire extinguishing system of claim 4 wherein, said controller means further contains algorithms adapted to execute a feedback loop for receiving information from said fire sensing means and further producing appropriate electrostatic field for fire control.

6. An electrostatic fire extinguishing system for the control and extinguishing of flames, said system comprising:

a) control panel means for receiving operator input, b) a high voltage static generator for producing high voltage static electricity, c) voltage regulator means for regulating the output levels of the static generator, d) controller means, wherein said controller means i) controls distribution of said power supply to said voltage regulator, ii) provides control signals to said high voltage static generator, and f) an electrostatic field grid means adapted for proximity placement for directly delivering a high voltage electrostatic field to a fire, wherein:

the high voltage electrostatic field acts as an electrode capable of interacting through an electrical force with ions in a flame of the fire.

7. An electrostatic fire extinguishing system for the control and extinguishing of flames, said system comprising:

a) control panel means for receiving operator input, b) a high voltage static generator for producing high voltage static electricity, c) voltage regulator means for regulating the output levels of the static generator, d) controller means, wherein said controller means i) controls distribution of said power supply to said voltage regulator, ii) provides control signals to said high voltage static generator, and f) an electrostatic field grid means adapted for proximity placement for directly delivering a high voltage electrostatic field to a fire for interaction with the fire utilizing an electrical force between the high voltage electrostatic field and ions in a flame of the fire.

8. The electrostatic fire extinguishing system of claim 7 further comprising:

at least one electrostatic fire sensing means for obtaining real-time electrostatic data about an ensuing flame, said sensing means adapted and configured to sense fire type, flame level, flame intensity and fire dimensions, and said fire sensing means electrically coupled to said controller means via a coaxial wire.

9. The electrostatic fire extinguishing system of claim 8 wherein, said controller means further contains algorithms adapted to execute a feedback loop for receiving information from said fire sensing means and further producing appropriate electrostatic field for fire control.

10. A method of controlling and extinguishing fires using a high voltage electrostatic field, said method comprising the steps of:

a) providing an electrostatic fire control and extinguishing device, said device having a high voltage generator for generating high voltage static electricity, means for adjusting the output voltage levels of said high voltage generator, an electrostatic field grid means for conducting said static electricity, means for electrically coupling said high voltage generator to said electrostatic field grid means;

b) producing a high voltage electrostatic field with said high voltage generator;

c) adjusting the output voltage levels of said high voltage generator;

d) coupling said high voltage electrostatic field to said electrostatic field grid means; and e) directly administering said high voltage electrostatic field, via said electrostatic field grid means, in close proximity to a flame for extinguishing said flame through utilizing an electrical force between the high voltage electrostatic field and ions in the flame.

* * * * *